US011378333B2

(12) United States Patent
Butts

(10) Patent No.: US 11,378,333 B2
(45) Date of Patent: Jul. 5, 2022

(54) SYSTEM AND METHOD FOR SEPARATING METHANE AND NITROGEN WITH REDUCED HORSEPOWER DEMANDS

(71) Applicant: BCCK Holding Company

(72) Inventor: Rayburn C. Butts, Midland, TX (US)

(73) Assignee: BCCK Holding Company, Midland, TX (US)

( * ) Notice: Subject to any disclaimer, the term of this patent is extended or adjusted under 35 U.S.C. 154(b) by 384 days.

(21) Appl. No.: 16/714,110

(22) Filed: Dec. 13, 2019

(65) Prior Publication Data

US 2021/0180863 A1 Jun. 17, 2021

(51) Int. Cl.
*F25J 3/02* (2006.01)

(52) U.S. Cl.
CPC ..... *F25J 3/0257* (2013.01); *F25J 3/0209* (2013.01); *F25J 3/0233* (2013.01); *F25J 2200/38* (2013.01); *F25J 2200/52* (2013.01); *F25J 2200/70* (2013.01); *F25J 2200/72* (2013.01); *F25J 2200/74* (2013.01);
(Continued)

(58) Field of Classification Search
CPC ..... F25J 3/0257; F25J 3/0209; F25J 3/0233; F25J 2200/38; F25J 2200/52; F25J 2200/70; F25J 2200/72; F25J 2200/74; F25J 2215/42; F25J 2215/60; F25J 2235/60; F25J 2250/42; F25J 2260/42; F25J 3/0238;
(Continued)

(56) References Cited

U.S. PATENT DOCUMENTS 3,398,546 A * 8/1968 Nelson ..... F25J 3/0219 62/935
4,323,380 A 4/1982 Mueller et al.
(Continued)

FOREIGN PATENT DOCUMENTS

DE 2962561 2/1981
EP 1065457 1/2001
(Continued)

OTHER PUBLICATIONS

Weidert et al., Integrated System The Key to Unlocking Gas Processing, Chart Energy and Chemicals, Inc., pp. 1-9.
(Continued)

*Primary Examiner* — Hoang M Nguyen
(74) *Attorney, Agent, or Firm* — Scheef & Stone, LLP; Robin L. Barnes

(57) ABSTRACT

A system and method for removing nitrogen from natural gas using two fractionating columns, that may be stacked, and a plurality of separators and heat exchangers, with horsepower requirements that are 50-80% of requirements for prior art systems. The fractionating columns operate at different pressures. A feed stream is separated with a vapor portion feeding the first column to produce a first column bottoms stream that is split into multiple portions at different pressures and first column overhead stream that is cooled and separated into vapor and liquid portions to control subcooling of the vapor portion prior to feeding the second column. Heat exchange between first column and second column streams provides first column reflux and reboil heat for a second column ascending vapor stream. Three sales gas streams are produced, each at a different pressure.

23 Claims, 1 Drawing Sheet

(52) U.S. Cl.
CPC ..... *F25J 2215/42* (2013.01); *F25J 2215/60* (2013.01); *F25J 2235/60* (2013.01); *F25J 2250/42* (2013.01); *F25J 2260/42* (2013.01)

(58) Field of Classification Search
CPC .. F25J 2200/04; F25J 2205/02; F25J 2205/04; F25J 2270/02
USPC ..... 62/622, 630, 631, 927
See application file for complete search history.

(56) References Cited

U.S. PATENT DOCUMENTS

| | | | | |
|---|---|---|---|---|
| 4,331,461 | A | 5/1982 | Karbosky et al. | |
| 4,352,685 | A * | 10/1982 | Swallow | F25J 3/0242 62/927 |
| 4,411,677 | A | 10/1983 | Pervier et al. | |
| 4,451,275 | A | 5/1984 | Vines et al. | |
| 4,474,591 | A | 10/1984 | Arand et al. | |
| 4,547,209 | A | 10/1985 | Netzer | |
| 4,609,390 | A | 9/1986 | Wilson | |
| 4,948,405 | A | 8/1990 | Thompson | |
| 5,041,149 | A | 8/1991 | Handley | |
| 5,051,120 | A | 9/1991 | Pahade et al. | |
| 5,141,544 | A | 8/1992 | Butts | |
| 5,257,505 | A | 11/1993 | Butts | |
| 5,375,422 | A | 12/1994 | Butts | |
| 6,116,051 | A | 9/2000 | Agrawal et al. | |
| 6,205,813 | B1 | 3/2001 | Shah et al. | |
| 6,758,060 | B2 * | 7/2004 | O'Brien | F25J 3/0238 62/631 |
| 7,520,143 | B2 | 4/2009 | Spilsbury | |
| 8,522,574 | B2 | 9/2013 | Crawford et al. | |
| 8,640,495 | B2 | 2/2014 | McNeil | |
| 8,869,553 | B2 | 10/2014 | Court et al. | |
| 9,816,752 | B2 * | 11/2017 | Butts | F25J 3/0238 |
| 9,920,986 | B2 | 3/2018 | Mak | |
| 2004/0177646 | A1 | 9/2004 | Wilkinson et al. | |
| 2004/0237581 | A1 | 12/2004 | Paradowski | |
| 2006/0144081 | A1 * | 7/2006 | Paradowski | F25J 3/0242 62/620 |
| 2007/0180855 | A1 | 8/2007 | Butts | |
| 2010/0223950 | A1 | 9/2010 | Malsam | |
| 2011/0289963 | A1 | 12/2011 | Price | |
| 2012/0324943 | A1 * | 12/2012 | Butts | F25J 3/0214 62/630 |
| 2014/0013797 | A1 | 1/2014 | Butts | |
| 2015/0052938 | A1 | 2/2015 | Bauer et al. | |
| 2018/0231306 | A1 | 8/2018 | Butts | |

FOREIGN PATENT DOCUMENTS

| | | |
|---|---|---|
| GB | 2208699 | 4/1989 |
| RU | 2121637 | 11/1998 |
| WO | WO2009144423 | 12/2009 |

OTHER PUBLICATIONS

Weidert et al., Holding the Key Article, Hydrocarbon Engineering, Reprinted from Aug. 2016, https://files.chartindustries.com/HoldintheKey-NewsArticle.pdf, retrieved from the Internet Nov. 12, 2019.

* cited by examiner

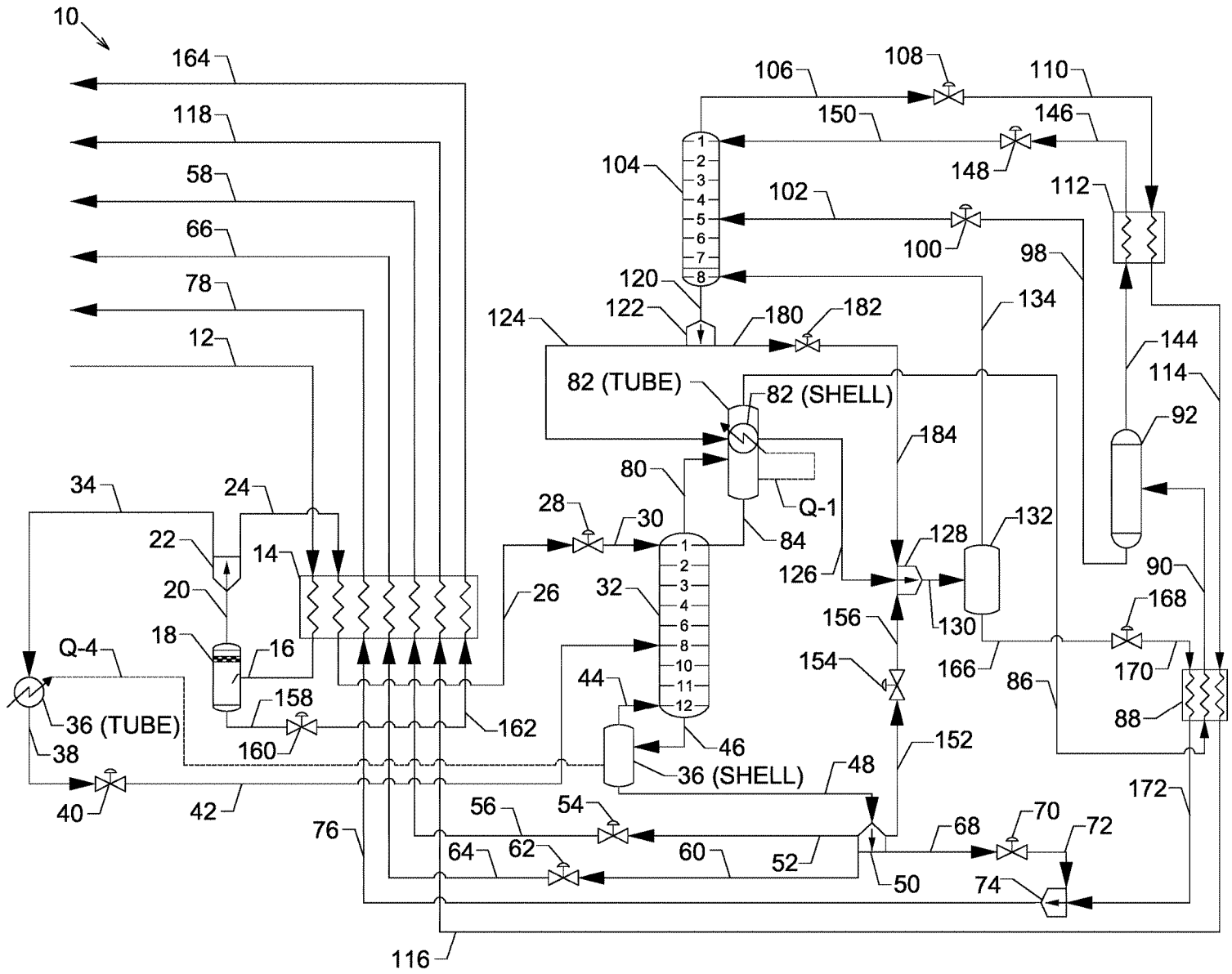
82 (SHELL)
82 (TUBE)
36 (SHELL)
36 (TUBE)
Q-1
Q-4

SYSTEM AND METHOD FOR SEPARATING METHANE AND NITROGEN WITH REDUCED HORSEPOWER DEMANDS

BACKGROUND OF THE INVENTION

1. Field of the Invention

This invention relates to a system and method for separating nitrogen from methane and other components from natural gas streams of around 20 MMSCFD or more with reduced energy/horsepower requirements compared to prior art systems and methods.

2. Description of Related Art

Nitrogen contamination is a frequently encountered problem in the production of natural gas from underground reservoirs. The nitrogen may be naturally occurring or may have been injected into the reservoir as part of an enhanced recovery operation. Transporting pipelines typically do not accept natural gas containing more than 4 mole percent inerts, such as nitrogen. As a result, the natural gas feed stream is generally processed to remove such inerts for sale and transportation of the processed natural gas.

One method for removing nitrogen from natural gas is to process the nitrogen and methane containing stream through a Nitrogen Rejection Unit or NRU. The NRU may be comprised of two cryogenic fractionating columns, such as that described in U.S. Pat. Nos. 4,451,275 and 4,609,390. These two column systems have the advantage of achieving high nitrogen purity in the nitrogen vent stream, but require higher capital expenditures for additional plant equipment, including the second column, and may require higher operating expenditures for refrigeration horsepower and for compression horsepower for the resulting methane stream.

The NRU may also be comprised of a single fractionating column, such as that described in U.S. Pat. Nos. 5,141,544, 5,257,505, and 5,375,422. Many single column systems have a single sales gas stream exiting the NRU fractionating column, usually at a lower pressure requiring compression to meet pipeline requirements. For example, in U.S. Pat. No. 5,141,544, an NRU feed stream is first processed to remove water and carbon dioxide (to avoid freezing problems associated in carbon dioxide) and is then split into three portions prior to feeding the single column NRU. A first portion is cooled through heat exchange with an overhead stream from the NRU column, a second portion is cooled through heat exchange with the NRU column bottoms stream, and a third portion is cooled through heat exchange with a side stream withdrawn from and returned to the NRU column in a reboiler for the NRU column. The first, second and third portions of the feed stream are recombined, the recombined stream is further cooled through heat exchange with the NRU column bottoms stream, and then passes through a JT valve prior to feeding into the NRU column as a liquid and vapor mixed phase stream around −215° F. and around 170 psia. The overhead stream from the single column NRU is the nitrogen vent stream. The single NRU bottoms stream is a sales gas stream at a pressure around 60 psia in the example in the '544 patent, requiring further compression.

Some single column systems also split the NRU column bottoms stream into two streams to allow for additional heat exchange with other process streams and resulting in two sales gas streams at different pressures. For example, in U.S. Pat. No. 5,375,422, an NRU feed stream is first processed to remove water and carbon dioxide and is then split into four portions prior to feeding the single column NRU. A first portion is cooled through heat exchange with an overhead stream from the NRU column; a second portion is cooled through heat exchange with a first portion of the NRU column bottoms stream after passing through the NRU column reboiler, then an internal reflux condenser in the NRU column, and then back through the reboiler; and a third portion is cooled through heat exchange with a second portion of a bottoms stream from the NRU column. The first, second and third portions of the feed stream are recombined and the recombined stream passes through a JT valve prior to feeding into the NRU column as a liquid and vapor mixed phase stream between −60 and −150° F. and around 315 psia. The fourth portion of the feed stream is cooled through two separate heat exchanges, each with a side stream withdrawn from and returned to the NRU column, before passing through a JT valve and feeding into the NRU column as a liquid and vapor mixed stream between −200 and −250° F. and around 315 psia. The fourth portion of the feed stream feeds into the NRU column at a location that is several trays above the recombined first, second, and third portions. The overhead stream from the single column NRU is the nitrogen vent stream. The NRU bottoms stream is split into the first and second portions, each of which is processed differently to achieve the desired heat exchange with other process streams. The different processing of the two portions of the NRU bottoms stream results in two sales gas streams, one at a pressure of around 20 psia and the other at a pressure around 300 psia. Such a single tower system producing only two sales gas streams, the horsepower per inlet MMSCF generally runs around 100 to 110 HP/MMSCF.

Compared to two column systems, these single column systems have the advantage of reduced capital expenditures on equipment, including elimination of the second column, and reduced operating expenditures because no external refrigeration equipment is necessary. However, they can also have higher operating expenditures related to energy/horsepower requirements. Many single column systems have horsepower requirements of around 110 HP/MMSCF of inlet feed, particularly for such systems with a single sales gas stream from the NRU column. The HP/MMSCF is improved with prior art single column systems that produce three sales gas streams at differing pressures, typically requiring between 80 and 90 HP/MMSCF. Similarly, prior art conventional two column systems producing a single sales gas stream (such as the '544 patent), the horsepower requirements generally run around 80 to 90 HP/MMSCF of inlet feed. In addition to capital and operating expenditures, many prior NRU systems have limitations associated with processing NRU feed streams containing high concentrations of carbon dioxide. Nitrogen rejection processes involve cryogenic temperatures, which may result in carbon dioxide freezing in certain stages of the process causing blockage of process flow and process disruption. Carbon dioxide is typically removed by conventional methods from the NRU feed stream, to a maximum of approximately 35 parts per million (ppm) carbon dioxide, to avoid these issues. There is a need for a system and method to efficiently separate nitrogen from methane and other components in natural gas streams with reduced energy/horsepower requirements and preferably with the capability to process feed streams with higher concentrations of carbon dioxide.

SUMMARY OF THE INVENTION

The system and method disclosed herein facilitate the economically efficient removal of nitrogen from methane with substantially reduced energy/horsepower requirements. The system and method are particularly suitable for feed gas flow rates of around 20 MMSCFD or more and having nitrogen contents ranging from 5 mol % to 50 mol %. The system and method are also capable of processing feed gas containing concentrations of carbon dioxide up to approximately 100 ppm for typical nitrogen levels between 5-50%. The system and method have horsepower requirements that are around 50-60% of the horsepower requirements for most prior art single column NRU systems with a single sales gas stream.

According to one embodiment of the invention, a system and method are disclosed for processing an NRU feed gas stream containing primarily nitrogen and methane through two fractionating columns to produce three processed sales gas streams, each at a different pressure, which may be further compressed as needed to be meet transporting pipeline requirements (typically around 615 psia). Most preferably, one sales gas stream is a high pressure stream having a pressure between 315-415 psia, a second sales gas stream is an intermediate pressure stream having a pressure between 75-215 psia (more preferably between 115-215 psia), and a third sales gas stream is a low pressure stream having a pressure between 45-115 psia (more preferably between 50-90 psia). An inlet feed stream is preferably separated in a first separator into an overhead vapor stream that feeds into a first stage column and a bottoms liquid stream that may be sent for further processing to recover remaining methane and NGL components. The first stage column is designed as a high pressure NRU column to remove the bulk of the incoming nitrogen from the methane and heavier hydrocarbon components, while the second stage column is operated at a lower pressure. The feed streams to the first stage NRU column and the first stage overhead stream are not cooled to traditional targeted temperatures of −200 to −245 degrees F. This allows the system and method of the invention to feed the first column at a warmer temperature than prior art systems, which increases $CO_2$ tolerance in the feed stream. The first column also operates at a higher pressure (preferably around 315-415 psia) compared to prior art systems. The second column operates at a lower pressure (preferably around 65-115 psia). The pressure differential between the two columns allows for efficient energy sharing between the columns, including through heat exchange between first and second column streams to provide reflux to the first column and reboil heat to the second column.

The overhead stream from the first stage column preferably feeds the second stage column, as does an overhead stream from a second separator that separates a portion of the first column bottoms stream and the second column bottoms stream. The second column overhead stream is a nitrogen vent stream and the second column bottom stream feeds into the second separator. The bottoms stream from the first column is split into four portions, each of which is expanded and cooled to varying degrees. One portion is combined with a bottoms stream from the second separator. That combined stream and two other portions of the first column bottoms stream are three separate sales gas streams, each at a different pressure. The fourth portion of the first column bottoms stream feeds into the second separator. The second separator is preferably located near grade elevation level to allow for instrumentation critical for optimal operation and for maintenance to be easily accessible.

According to another preferred embodiment, the feed stream is cooled in a first heat exchanger prior to feeding the first separator through heat exchange with the first separator bottoms stream, the first column bottoms stream, the second separator bottoms stream, and the second column overhead stream. According to another preferred embodiment, the first separator overhead stream is split into two portions, a first portion of which is recycled back through the first heat exchanger to be further cooled prior to feeding the first column. A second portion is cooled and provides reboil heat to a reboiler for the first column prior to feeding the first column.

According to another preferred embodiment, there is heat exchange between streams from the first and second columns. Most preferably a shell and tube style heat exchanger is used, which provides the same function as an internal knockback condenser, but with the flexibility of two independent pieces of equipment, to provide reflux to the top of the first stage column and reboil heat to the bottom of the second stage column. A stream from a top of the first column feeds into a tube side of the heat exchanger, with a liquid portion returning to the column and a vapor portion exiting the column as the first column overhead stream. A portion of the second column liquid bottoms stream enters the shell side of the heat exchanger, where it is warmed to a vapor stream that is combined with a second portion of the second column liquid bottoms stream prior to feeding into the second separator. The second separator overhead stream feeds back into the second column as an ascending vapor stream. According to one preferred embodiment, the two columns are erected independently, most preferably with at least part of the second column being located at an elevation higher than the first column and the heat exchanger being at least partially elevated relative to the first column so that the portion of the second column bottoms stream may feed into the shell side of the heat exchanger by gravity feed. According to another preferred embodiment, the first and second stage columns may be stacked with the second column above the first column, effectively into a single column, as will be understood by those of ordinary skill in the art. According to another preferred embodiment, the two columns may be erected inside a cold box, but a cold box is not required.

According to another preferred embodiment, the first column overhead stream is cooled upstream of feeding the second column in a second heat exchanger through heat exchange with the second separator bottoms stream and the second column overhead stream. According to yet another preferred embodiment, the cooled first column overhead stream passes through a third separator or flash drum downstream of the second heat exchanger to allow a desired amount of vapor from the cooled first column overhead stream to pass through a third heat exchanger to further cool the stream and condense it prior to feeding a top of the second column. This additional cooling results from heat exchange with the second column overhead stream in the third heat exchanger. Preferably, the amount of vapor withdrawn from the third separator is controlled to achieve the desired heat balance in the third heat exchanger. Most preferably, the remaining vapor from the cooled first column overhead stream exits the third separator and is combined with the liquid portion of the stream exiting the third separator to feed into a middle section of the second column.

The primary advantage of the preferred embodiments of the system and method disclosed herein is substantially reduced energy/horsepower requirements compared to prior art single column systems. By splitting a bottoms stream from the first column into three separate sales gas streams, each at a different pressure, with the low pressure stream preferably between 45 to 115 psia, preferred embodiments of the system and method can achieve a substantial reduction in energy/horsepower requirements to around 65 to 75 HP/MMSCF of inlet feed. Many single column prior art systems having a single sales gas stream exiting the NRU column or even two sales gas streams have horsepower requirements of around 110 HP/MMSCF of inlet feed. The horsepower requirements are reduced in many prior art conventional two column systems producing a single gas stream to around 80 to 90 HP/MMSCF of inlet feed. The horsepower requirements are similarly reduced in many prior art single column systems that produce three sales gas streams at differing pressures to around 80 to 90 HP/MMSCF of inlet feed. However, a further reduction to around 65 to 75 HP/MMSCF of inlet feed is achievable according to preferred embodiments of the system and method of the invention.

For inlet feed conditions like those in the computer simulation Example 1 described below, a prior art single column design with the NRU bottoms stream split into two streams at different pressures (like in the '422 patent) would require around 11,000 hp (or around 110 hp per inlet feed MMSCF of gas); however, a preferred embodiment of the invention can process that inlet gas feed stream using only 6,650 hp—a difference of more than 4,350 hp. That difference equates to around $4,300,000 in installed cost plus the added fuel demand and lower associated emissions that are saved using a preferred embodiment of the invention over prior art single column designs. The operating cost savings over the capital cost differential between a prior art single column and two column system according to a preferred embodiment of the invention would be around 25% of the total installed costs. One of the aspects that results in the lower energy/horsepower requirements is the availability of three sales gas streams, each at a different pressure level, exiting the NRU first column. The pressure levels of the three streams is higher than prior art systems that split the NRU column bottoms stream into two or three sales streams. For example, in U.S. Pat. No. 9,816,752 the NRU column bottoms stream is split into three streams—a low pressure sales stream at around 15 psia, an intermediate pressure sales stream at around 111-132 psia, and a high pressure sales stream at around 248-271 psia and requires more HP/MMSCF of inlet feed than preferred embodiments of the system and method herein where the pressures of the three sales streams (particularly the low pressure sale stream) are higher. For example, a low pressure sales stream according to the invention may have a pressure of around 55 psia compared to around 15 psia in the '752 patent. Although this does not seem like a large pressure difference, there is a significant difference in HP required to compress any given volume with this higher pressure. When multiple sales gas streams are produced at different pressures, they typically undergo multiple stages of compression where a lower pressure stream is compressed in a first stage and then combined with a higher pressure stream, the combined stream is then compressed in a second stage, etc. until all of the sales gas streams are recombined into a single, final sales gas stream at the desired pressure (typically around 800 psig for pipeline requirements). Most preferably, systems and method according to the invention will allow the use of at least one less stage of compression to achieve the desired end pressure for the final sales gas stream, resulting in a substantial energy/horsepower reduction.

BRIEF DESCRIPTION OF THE DRAWINGS

The system and method of the invention are further described and explained in relation to the following drawing wherein:

FIG. 1 is a process flow diagram illustrating a preferred embodiment of a methane and nitrogen separation system and method according to the invention.

DESCRIPTION OF THE PREFERRED EMBODIMENTS

Referring to FIG. 1, system 10 for separating nitrogen from methane from an NRU feed stream 12 according to one preferred embodiment of the invention is depicted. Where present, it is generally preferable for purposes of the present invention to remove as much of the water vapor and other contaminants from the NRU feed gas 12 as is reasonably possible prior to processing stream 12 through system 10. It may also be desirable to remove excess amounts of carbon dioxide prior to separating the nitrogen and methane; however, the method and system are capable of processing NRU feed streams containing up to approximately 100 ppm carbon dioxide without encountering the freeze-out problems associated with prior systems and methods. Methods for removing water vapor, carbon dioxide, and other contaminants are generally known to those of ordinary skill in the art and are not described herein.

NRU feed stream 12 preferably comprises around 5-50% nitrogen, more preferably around 10-40% nitrogen and is at a temperature between 50-120 F, more preferably between 80-100 F, and a pressure of 550-1015 psia. Feed stream 12 is preferably cooled in a first heat exchanger 14 to a temperature between 0 to −75° F. before feeding into a first separator 18 as stream 16. A bottoms liquid stream 158 from first separator 18 is warmed in first heat exchanger 14 and is then sent for further processing as stream 164 to refine contained NGL components. An overhead vapor stream 20 from first separator 18 is split into streams 24 and 34. Stream 24 is recycled back through first heat exchanger 14 where it is cooled and condensed prior to passing through a JT valve 28 and then feeding into an upper level of first fractionating column 32 as liquid stream 30. Stream 34 passes through a tube side of a reboiler 36 for the first column 32 where it is cooled and partially condensed before passing through valve 40 (most preferably a throttle valve) and then feeding into a mid-to-lower level of first fractionating column 32 as mixed liquid-vapor stream 42. First column 32 is preferably operated at pressures ranging from 315-415 psia, more preferably from 325-385 psia with feed stream (streams 30 and 42) temperatures ranging from −210 to −170 F, more preferably −205 to −175 F.

A liquid stream 46 from a bottom of first column 32 passes through a shell side of reboiler 36 with a vapor portion 44 returning to the bottom of column 32 and a liquid portion 48 exiting as a first column bottoms stream. Bottoms stream 48 preferably comprises around 1-4% nitrogen, more preferably 2-3% nitrogen. Bottoms stream 48 is preferably split into four portions 52 (first portion), 60 (second portion), 68 (third portion), and 152 (fourth portion) in splitter 50. Each portion passes through a valve 54, 62, 70, 154 where it is partially vaporized, reducing the temperature and pressure of the exiting streams 56 (first portion), 64 (second portion), 72 (third portion), and 156 (fourth portion) to varying degrees. Stream 56 preferably has a pressure of 325-385 psia and a temperature of −145 to −165° F. before being warmed in first heat exchanger 14 to become a high pressure sales gas stream 58. Stream 64 preferably has a pressure of 150-175 psia and a temperature of −175 to −200° F. before being warmed in first heat exchanger 14 to become an intermediate pressure sales gas stream 66. Stream 72 preferably has a pressure of 45-105 psia and a temperature of −200 to −235° F. before being mixed in mixer 74 with a bottoms stream from second separator 132 to form stream 76. Stream 76 preferably has a pressure of 45-105 psia and a temperature of −200 to −235° F. before being warmed in first heat exchanger 14 to become a low pressure sales gas stream 78.

Most preferably, high pressure sales gas stream 58 is at a pressure between 315-415 psia, and is at a pressure higher than intermediate sales gas stream 66 and higher than low pressure sales gas stream 78. Most preferably, intermediate pressure sales gas stream 66 is at a pressure between 145-215 psia, and is at a pressure lower than high sales gas stream 58 and higher than low pressure sales gas stream 78. Most preferably, low pressure sales gas stream 78 is at a pressure between 45-105 psia, and is at a pressure lower than intermediate sales gas stream 66 and lower than high pressure sales gas stream 58. The pressures of high pressure sales gas stream 58 and lower pressure sales gas stream 78 are substantially higher than prior art systems, such as U.S. Pat. No. 9,816,752, where the bottoms stream from the NRU column is separated into multiple streams at different pressures. The pressures of the high pressure sales gas stream 58 and intermediate sales gas stream 66 are also substantially higher than other prior art systems having only a single sales gas stream from the bottoms of the NRU column, such as U.S. Pat. No. 5,141,544. Each sales gas stream preferably comprises at no more than 4% nitrogen.

First fractionating column overhead stream 86 preferably comprises around 20-40% methane and 60-80% nitrogen. First column overhead stream 86 is cooled and partially condensed in a second heat exchanger 88, before entering a third separator or flash drum 92 as stream 90. Cooled first column overhead stream 90 is separated in third separator 92 into a primarily liquid bottoms portion 98 and a vapor overhead portion 144. The amount of vapor exiting the third separator 92 is controlled by the amount of vapor needed to achieve certain thermal conditions as dictated by the requirements of the heat exchanger 112. Specifically, the amount of vapor entering the third exchanger 112 is determined by the difference in temperature between streams 144 and 114 so that stream 114 preferably exits the third heat exchanger 112 at temperature approximately 2 to 5° F. colder than stream 144. The excess vapor, not required by the heat exchanger 112, exits the third separator 92 from the bottom of the separator with the exiting liquid as stream 98. Vapor stream 144 is then cooled and condensed in the third heat exchanger 112 prior to feeding into a top of the second column 104 as a liquid reflux stream 150. Third separator 92 is designed to allow a measured amount of vapor flow from the cooled first column overhead stream 90, to pass through third heat exchanger 112 to control subcooling stream 144 prior to feeding into the top of the second column 104 as stream 150. The amount of subcooling achieved in the third exchanger 112 is preferably approximately 40 to 80° F. This subcooling is required to cool the overhead of the second tower, stage 1, to an adequately low temperature to create reflux inside of the second tower 104. This reflux is required to achieve a high degree of methane/nitrogen separation within the second tower 104 and to achieve a preferred purity of nitrogen exiting the second tower 104 of approximately 96-99%, most preferably at least approximately 98%. The balance of the vapor present in stream 90 and not utilized by the exchanger 112 exits the third separator along with the liquid present in stream 90 as stream 98. The two phase stream 98 then enters the expansion valve 100 where the pressure and temperature are preferably reduced 55-75 psia, more preferably around 70 psia, and a temperature of −265 to −285° F., more preferably around −275° F. respectively.

Second column 104 is preferably operated at pressures ranging from 50-115 psia, more preferably from 55-75 psia with feed stream (streams 150, 102, 134). The approximate feed temperature of stream 150 feeding the top of the second tower is approximately −295° F. The temperature feeding the intermediate feed, mid column is approximately −275° F. and the temperature feeding the column bottom is approximately −225° F. The subcooled liquid stream 150 entering the column top into tray 1 provides the required reflux for the column and the vapor entering as stream 134 provides the reflux vapor. An overhead stream 106 from the second column 104 is routed to an expansion valve 108 where the temperature and pressure are further reduced. The approximate temperature at this point is preferably −290 to −310° F., most preferably approximately −300° F. The vapor exiting the expansion valve 108 is then warmed in third heat exchanger 112, then warmed again in second heat exchanger 88, then warmed again in the first heat exchanger 14 before exiting system 10 as nitrogen vent stream 118.

Nitrogen vent stream 118 preferably comprises less than 2% methane and more than 98% nitrogen. A liquid bottoms stream 120 from second column 104 is split in splitter 122 into two portions 124 and 180 that are later recombined, along with a fourth portion of the bottoms stream from first column 32, in mixer 128 to form stream 130, which feeds into second separator 132. A first portion of the bottoms stream from column 104, stream 124, is warmed in a shell side of heat exchanger 82 upstream of mixer 128. A second portion of the bottoms stream from column 104, stream 180, enters temperature control valve 182 upstream of mixer 128. The placement of this control valve 182, and the piping configuration involving streams 124, 180, 184, and 126, are important aspects to operation of system 10 in that it provides the pressure drop necessary to offset the pressure loss through the shell side of heat exchanger 82.

Stream 130 preferably feeds into second separator 132 at a temperature −220 to −235° F. and a pressure between 50-75 psia. An additional two phase stream 156 (a partially vaporized fourth portion of the first column bottoms stream, preferably at a temperature of −220 to −210° F. and a pressure between 50-115 psia) is added to separator 132 to provide additional refrigeration as required to allow exchanger 88 to function properly. Stream 156 is preferably mixed with two portions of the bottoms stream from second column 104 in mixer 128 to form stream 130 prior to feeding into second separator 132. A vapor stream 134 exits the separator 132 and is then routed to the second column 104. Likewise, a liquid stream 166, preferably comprising less than 4% nitrogen and more preferably less than 2% nitrogen, exits the separator 132. Second column 104 preferably does not comprise a reboiler, but uses heat exchanger 82 and second separator 132 to effectively act as a reboiler with stream 134 being returned to a bottom of column 104 as an ascending vapor stream. Bottoms stream 166 from second separator 132 is then routed to level valve 168 as required to hold a desired liquid level in the separator 132. Stream 166 exits the level valve 168 as stream 170 where it then enters heat exchanger 88. Stream 170 is warmed in second heat exchanger 88 before mixing in mixer 74 with a third portion 72 of the bottoms stream from first column 32 to form low pressure sales gas stream 78.

System 10 utilizes efficient heat exchange between various process streams to improve process performance. In first heat exchanger 14, feed stream 12 and a portion 24 of an overhead stream from first separator 18 are cooled through heat exchange with first portion 66 of the first column bottoms stream, second portion 64 of the first column bottoms stream, mixed stream 76, overhead stream 116 from the second column 104 (downstream of heat exchange in second heat exchanger 88 and third heat exchanger 112) and a bottoms stream 162 from the first separator 18. The feed stream 12 is cooled in first heat exchanger 14 upstream of feeding first separator 18. The purpose of separator 18 is to provide separation of heavier hydrocarbon components such as propane, butanes and gasolines from the inlet feed stream 12 before entering the colder part of the system 10. Portion 24 is cooled in first heat exchanger 14 upstream of routing the stream to the first column 32. In second heat exchanger 88, overhead stream 86 from first column 32 is cooled through heat exchange with overhead stream 114 from second column 104 (downstream of heat exchanger in third heat exchanger 112) and bottoms stream 170 from second separator 132. Overhead stream 86 is cooled in second heat exchanger 88 prior to feeding third separator 92. In third heat exchanger 112, stream 144 from third separator 92 is subcooled through heat exchange with overhead stream 110 from second column 104. System 10 also preferably allows for heat exchange between a second portion 34 of the overhead stream from the first separator 18 and a liquid stream 46 from a bottom of column 32 in a reboiler 36. The exchanger 36 (tube) is the tube side of a shell and tube style heat exchanger used to provide the necessary heat source for the bottom of the first column 32. The exchanger depicted as 36 (shell) is the shell side of the exchanger 36.

System 10 preferably also comprises a fourth heat exchanger comprising a tube side 82 (tube) and a shell side 82 (shell), that are independent pieces of equipment configured as a vertical tube, falling film condenser. Heat exchanger 82 (tube) and 82 (shell) provide the similar function as an internal knockback condenser (like that described in U.S. Patent Application Publication 2007/0180855, incorporated herein by reference). A vapor stream 80 from a top of first column 32 passes through a tube side 82 (tube) of a heat exchanger 82 (tube), where it is partially condensed, with a vapor portion exiting as first fractionating column overhead stream 86 and a liquid portion 84 returning to column 32. The refrigerant source for heat exchanger 82 is a first portion of the bottom fluid from the second column 104, which is routed to the shell side of the exchanger 82, and the condensed liquid from first column overhead stream is designed to operate on the tube side of exchanger 82. The first portion 124 of the bottoms stream from second column 104 passes through the shell side 82 (shell), preferably by gravity feed, where heat is added resulting in a partial or total vaporization of stream 124 and exiting the exchanger 82 (shell) as stream 126. Stream 126 is then mixed with the liquid second portion of the bottoms stream from the second column 104 to form stream 130, which feeds into second separator 132. Column 104 is preferably located in an elevated position relative to column 32, and the two may be stacked together to effectively form a single column, with elevated heat exchanger 82 preferably mounted between column 104 and column 32 and at least partially elevated relative to column 32. This allows gravity feed of the liquid from stream 124 through the shell side 82 (shell) of the fourth heat exchanger, like in a knockback condenser, so that it is not necessary to use a conventional reflux condenser that requires a pump to circulate the refrigerant liquid, which can add undesirable heat to the liquid. Utilizing fourth heat exchanger 82 allows system 10 to operate with less refrigerant (horsepower) resulting in lower cost and greater flexibility. This fourth heat exchanger provides reflux to column 32 and, coupled with second separator 132, reboil heat to column 104. Although it is known in the prior art to use a knockback condenser, the configuration of heat exchanger 82 (shell) and 82 (tube) and the pressures and temperatures used in system 10 are different from the prior art. In the prior art, the knock back condenser had a single purpose, which is to remove heat from the column 32 overhead. In the configuration of exchanger 82 in system 10, the purpose is twofold. As with the prior art, the exchanger 82 is still utilized to provide the removal of heat from the overhead of column 32, but the primary purpose of exchanger 82 is to provide a heat source to reboil the second column 104. In operation, the controls are adjusted to provide for the second column heat and are not designed to remove heat from the first column 32 against a specific target. The pressure difference between the two columns allows for this interchange of heat. The piping configuration to allow satisfactory operation of this exchanger 82 is an important aspect of system 10 must be designed so as to allow for the correct amount of heat input into stream 124.

Acceptable inlet compositions in which this invention may operate satisfactorily are listed in the following Table 1:

TABLE 1

INLET STREAM COMPOSITIONS

| Inlet Component | Acceptable Inlet Composition Ranges |
|---|---|
| Methane | 50-95% |
| Ethane and Heavier Components | 0-20% |
| Carbon Dioxide | 0-100 ppm |
| Nitrogen | 5-50% |

Example 1—Computer Simulation for 100 MMSCFD Feed with 20% Nitrogen

Still referring to FIG. 1, a system and method for processing a 100 MMSCFD NRU feed stream 12, comprising approximately 20 mol % nitrogen and 72 mol % methane at 120° F. and 664.5 psia based on a computer simulation is shown and described below. Feed stream 12 passes through first heat exchanger 14, which preferably comprises a plate-fin heat exchanger. The feed stream emerges from the heat exchanger and enters separator 18 having been cooled to −17.4° F. as stream 16. This cooling is the result of heat exchange with other process streams 56, 64, 76, 116, and 162. The cooled stream 16 is then separated into an overhead vapor stream 20 and a bottoms liquid stream 158. Bottoms liquid stream 158 comprises around 1.8% nitrogen, 26% methane, 10% ethane, and 14% propane. The pressure of stream 158 is reduced in valve 160 to around 165 psia in mixed liquid-vapor stream 162. Stream 162 is then warmed in heat exchanger 14, exiting as stream 164 at 101.7° F. and 160 psia. Stream 164 may be sent to a stabilizer column (not shown) for further processing.

Overhead vapor stream 20, comprising around 20% nitrogen and around 73% methane is split in splitter 22 into streams 24 and 34. Stream 24 is then routed for another pass through heat exchanger 14, exiting as a subcooled liquid stream 26 having been cooled to −195° F. Stream 26 passes through a pressure reducing valve 28, exiting as stream 30 with a pressure around 380 psia. Stream 30 feeds into an upper tray level on first fractionating column 32. First fractionating column 32 is preferably a high pressure column upstream of a low pressure second fractionating column 104. Vapor stream 34, the other portion of the first separator overhead stream, passes through the tube side of exchanger 36 in order to provide heat for the reboiler 36 for first fractionating column 32, exiting as mixed liquid-vapor stream 38 having been cooled to around −138° F. Around 8.04 million Btu/Hr of heat energy (Q-4) passes from tube side of reboiler 36 (tube) (from stream 34) to shell side of reboiler 36 (shell) (to stream 46). Stream 38 passes through temperature control valve 40 (preferably a throttling valve), exiting as stream 42 with a reduced pressure of around 391 psia. Mixed liquid-vapor stream 42 feeds into first fractionating column 32 near a mid-level tray location. Stream 80 comprising around 59% nitrogen and 40.5% methane at −189° F. from the top of column 32 feeds into a tube side 82 (shell) of a shell and tube heat exchanger that acts as a condenser for column 32. A liquid portion of stream 80 returns to column 32 as stream 84 and a vapor portion exits tube side 82 (tube) as overhead stream 86 comprising around 66% nitrogen and 34% methane at −199° F. and 385 psia. Around 1.86 million Btu/hr of heat energy (Q-1) passes from tube side 82 (tube) to shell side 82 (shell).

First column overhead stream 86 passes through second heat exchanger 88, which preferably comprises a plate-fin heat exchanger, exiting as cooled, mixed liquid-vapor stream 90 at −224° F. Stream 90 then enters a third separator or flash drum 92 where it is separated into liquid stream 98 and vapor stream 144. Stream 98 comprises 63% nitrogen and 37% methane at −224° F. and 379 psia. Stream 98 passes through valve 100, existing as stream 102 at −276° F. with a pressure of around 70 psia. Stream 102 feeds into a mid-level of second fractionating column 104. Vapor stream 144 passes through third heat exchanger 112, which preferably comprises a plate-fin heat exchanger, exiting as stream 146 having been subcooled to around −296° F. Stream 146 then passes through valve 148 to reduce the pressure of exiting stream 150 to around 70 psia. Stream 150 comprising around 86% nitrogen and 14% methane at −295° F. and 70 psia then feeds into an upper level of column 104. A third stream, stream 134 comprising around 20% nitrogen and 80% methane at −226° F. and 65 psia, also feeds into a lower level of column 104 as an ascending vapor stream.

Components of feed streams 150, 102, and 134 are separated in second fractionating column 104 into an overhead stream 106 and a bottoms stream 120. Overhead stream 106 comprises around 98% nitrogen and less than 2% methane at −290° F. and 62.5 psia before passing through valve 108, existing at stream 110 at −300° F. and 20 psia. Stream 110 passes through third heat exchanger 112, exiting as stream 114 warmed to −229° F. Stream 114 then passes through second heat exchanger 88, exiting as stream 116 warmed to −204° F. Stream 116 then passes through first heat exchanger 14, exiting as stream 118 warmed to 101.7° F. Stream 118 is the nitrogen vent stream for system 10.

Bottoms stream 120 comprising around 9% nitrogen and 91% methane at −246° F. and 65 psia is split in splitter 122 into streams 124 and 180. Liquid stream 124 passes through the shell side 82 (shell) of a shell and tube heat exchanger that acts as a condenser for column 32, exiting as vapor stream 126 at around −221° F. Stream 180 passes through valve 182, exiting as stream 184. Streams 184 and 126 are mixed in mixer 128 to form stream 130 that feeds into a low pressure second separator 132. Valve 182 is used to control the temperature of mixed stream 130 feeding into separator 132, by controlling a flow rate of stream 180 inversely relative to stream 124. Stream 156 is also preferably mixed in mixer 128 to form stream 130, but may also be separately fed into separator 132. Stream 130 (and 156 if separate from 130) are separated in separator 132 into overhead vapor stream 134 and bottoms liquid stream 166. Stream 134 is returned to second fractionating column 104 as an ascending vapor stream providing heat to the second column as is similar to having a reboiler in second column 104. Bottoms stream 166 comprises less than 2% nitrogen and around 96% methane at −226° F. and 65 psia. Stream 166 passes through level valve 168, exiting as stream 170 with a slight pressure reduction to 60 psia. Stream 170 passes through heat exchanger 88, exiting as stream 172 having been warmed to −204° F. Stream 172 is mixed with a partially vaporized third portion 72 of a bottoms stream from fractionating column 32 in mixer 74 to form mixed stream 76.

Liquid stream 46 from a bottom of column 32 passes through reboiler 36 (shell) where there is heat exchange with stream 34 (which is a portion of first separator overhead stream for system 10). A vapor portion 44 of stream 46 returns to the bottom of column 32 and a liquid portion exits as bottoms stream 48 comprising less than 2% nitrogen and around 89% methane at −145° F. and 388.5 psia. Bottoms stream 48 is then split in splitter 50 into streams 52, 60, 68 and 152. Stream 52 passes through valve 54, exiting as stream 56 at 345 psia. Stream 56 then passes through heat exchanger 14, exiting as stream 58 having been warmed to around 101.5° F. and at a pressure of 340 psia. Stream 58 is one of the three sales gas streams. Stream 60 passes through valve 62, exiting as stream 64 at −183° F. and a pressure of 165 psia. Stream 64 then passes through heat exchanger 14, exiting as stream 66 having been warmed to around 101.7° F. and a pressure of 160 psia. Stream 66 is a second of the sales gas streams. Stream 68 passes through valve 70, exiting as stream 72 having been cooled to −216° F. at a pressure of 65 psia. Stream 72 is mixed with stream 172 in mixer 74 to form stream 76 at −217.8° F. and 57.5 psia, which passes through heat exchanger 14 exiting as stream 78 at 101.7° F. and 55 psia. Stream 78 is a third sales gas stream. Of the sales gas streams, stream 58 is a high pressure stream (higher than streams 66 and 78) and depending on the requirements of the installation, this stream may not need further compression to enter existing facility equipment or the compression requirements would be significantly reduced when compared with existing nitrogen rejection technologies. Stream 66 is an intermediate pressure stream (lower pressure than stream 58 but higher pressure than stream 78), and stream 78 is a low pressure stream (lower pressure than streams 58 and 66). These streams 66 and 78 may be further compressed as needed to meet pipeline requirements.

Stream 152, the fourth portion split from bottoms stream 48, passes through valve 154, exiting as partially vaporized stream 156 having been cooled to −214° F. at a pressure of 70 psia. Stream 156 is the third stream to enter mixer 128. The mixed stream from 128 exits as stream 130 and feeds into second separator 132.

For inlet feed conditions in Example 1, a prior art single column design would require around 11,000 hp (or around 110 hp per inlet feed MMSCF of gas); however, a preferred embodiment of the invention according to FIG. 1 can process that inlet gas feed stream using only 6,650 hp, which is around 60% of the horsepower required in the prior art system. That difference equates to around $4,300,000 in installed cost plus the added fuel demand that are saved using a preferred embodiment of the invention as depicted in FIG. 1 over prior art single column designs. The operating cost savings over the capital cost differential between a prior art single column and two column system according to the preferred embodiment in FIG. 1 would be around 25% of the total installed costs.

The specific flow rates, temperatures, pressures, and compositions of various flow streams referred to in connection with the above discussion of a computer simulation for a system 10 appear in Table 2 below. These values are based on a feed gas stream 12 comprising 20% nitrogen, around 73% methane, and 50 ppm of carbon dioxide with a flow rate of 100 MMSCFD.

TABLE 2

FLOW STREAM PROPERTIES

| Mole Fraction/ | Stream No. | | | | | | |
|---|---|---|---|---|---|---|---|
| Property | 12 | 16 | 20 | 24 | 26 | 30 | 34 |
| Nitrogen | 20.0000* | 20.0000 | 20.1842 | 20.1842 | 20.1842 | 20.1842 | 20.1842 |
| CO2 | 0.005* | 0.005 | 0.00499903 | 0.00499903 | 0.00499903 | 0.00499903 | 0.00499903 |
| Methane | 72.7672* | 72.7672 | 73.2420 | 73.2420 | 73.2420 | 73.2420 | 73.2420 |
| Ethane | 4.28875* | 4.28875 | 4.22698 | 4.22698 | 4.22698 | 4.22698 | 4.22698 |
| Propane | 1.64580* | 1.64580 | 1.51655 | 1.51655 | 1.51655 | 1.51655 | 1.51655 |
| i-Butane | 0.313443* | 0.313443 | 0.251551 | 0.251551 | 0.251551 | 0.251551 | 0.251551 |
| n-Butane | 0.616397* | 0.616397 | 0.445057 | 0.445057 | 0.445057 | 0.445057 | 0.445057 |
| i-Pentane | 0.126174* | 0.126174 | 0.0640669 | 0.0640669 | 0.0640669 | 0.0640669 | 0.0640669 |
| n-Pentane | 0.103348* | 0.103348 | 0.0447387 | 0.0447387 | 0.0447387 | 0.0447387 | 0.0447387 |
| Hexane | 0.133944* | 0.133944 | 0.0198272 | 0.0198272 | 0.0198272 | 0.0198272 | 0.0198272 |
| Temperature ° F. | 120* | −17.4194 | −17.4875 | −17.4875 | −195* | −195.038 | −17.4875 |
| Pressure psia | 664.5* | 659.5 | 658.5 | 658.5 | 653.5 | 380* | 658.5 |
| Mole Fraction Vapor % | 100 | 99* | 100 | 100 | 0 | 0 | 100 |
| Std Vapor Volumetric Flow MMSCFD | 100* | 100 | 98.9982 | 70.5388 | 70.5388 | 70.5388 | 28.4594 |

| Mole Fraction/ | Stream No. | | | | | | |
|---|---|---|---|---|---|---|---|
| Property | 38 | 42 | 44 | 46 | 48 | 52 | 56 |
| Nitrogen | 20.1842 | 20.1842 | 7.76154 | 3.73594 | 1.93914 | 1.93914 | 1.93914 |
| CO2 | 0.00499903 | 0.00499903 | 0.00166185 | 0.00531146 | 0.00694044 | 0.00694044 | 0.00694044 |
| Methane | 73.2420 | 73.2420 | 91.6747 | 89.7532 | 88.8955 | 88.8955 | 88.8955 |
| Ethane | 4.22698 | 4.22698 | 0.527887 | 4.23647 | 5.89178 | 5.89178 | 5.89178 |
| Propane | 1.51655 | 1.51655 | 0.0315056 | 1.47234 | 2.11545 | 2.11545 | 2.11545 |
| i-Butane | 0.251551 | 0.251551 | 0.00111929 | 0.242955 | 0.350896 | 0.350896 | 0.350896 |
| n-Butane | 0.445057 | 0.445057 | 0.00154193 | 0.429712 | 0.620824 | 0.620824 | 0.620824 |
| i-Pentane | 0.0640669 | 0.0640669 | 2.12102E−05 | 0.0617961 | 0.0893689 | 0.0893689 | 0.0893689 |
| n-Pentane | 0.0447387 | 0.0447387 | 2.53333E−05 | 0.0431562 | 0.0624074 | 0.0624074 | 0.0624074 |
| Hexane | 0.0198272 | 0.0198272 | 1.62426E−06 | 0.0191229 | 0.0276576 | 0.0276576 | 0.0276576 |
| Temperature ° F. | −137.715* | −160.830 | −145.335 | −151.495 | −145.335 | −145.335 | −151.019 |
| Pressure psia | 653.5 | 391.273* | 388.5 | 388.5 | 388.5 | 388.5 | 345* |
| Mole Fraction Vapor % | 40.1571 | 50.8018 | 100 | 0 | 0 | 0 | 4.97369 |
| Std Vapor Volumetric Flow MMSCFD | 28.4594 | 28.4594 | 31.6770 | 102.647 | 70.9699 | 42.2528 | 42.2528 |

| Mole Fraction/ | Stream No. | | | | | | |
|---|---|---|---|---|---|---|---|
| Property | 58 | 60 | 64 | 66 | 68 | 72 | 76 |
| Nitrogen | 1.93914 | 1.93914 | 1.93914 | 1.93914 | 1.93914 | 1.93914 | 1.91624 |
| CO2 | 0.00694044 | 0.00694044 | 0.00694044 | 0.00694044 | 0.00694044 | 0.00694044 | 0.00390743 |
| Methane | 88.8955 | 88.8955 | 88.8955 | 88.8955 | 88.8955 | 88.8955 | 93.0578 |
| Ethane | 5.89178 | 5.89178 | 5.89178 | 5.89178 | 5.89178 | 5.89178 | 3.23637 |
| Propane | 2.11545 | 2.11545 | 2.11545 | 2.11545 | 2.11545 | 2.11545 | 1.15643 |
| i-Butane | 0.350896 | 0.350896 | 0.350896 | 0.350896 | 0.350896 | 0.350896 | 0.191808 |
| n-Butane | 0.620824 | 0.620824 | 0.620824 | 0.620824 | 0.620824 | 0.620824 | 0.339356 |
| i-Pentane | 0.0893689 | 0.0893689 | 0.0893689 | 0.0893689 | 0.0893689 | 0.0893689 | 0.0488510 |
| n-Pentane | 0.0624074 | 0.0624074 | 0.0624074 | 0.0624074 | 0.0624074 | 0.0624074 | 0.0341132 |
| Hexane | 0.0276576 | 0.0276576 | 0.0276576 | 0.0276576 | 0.0276576 | 0.0276576 | 0.0151182 |
| Temperature ° F. | 101.540 | −145.335 | −183.260 | 101.727* | −145.335 | −216.425 | −217.785 |
| Pressure psia | 340 | 388.5 | 165* | 160 | 388.5 | 65* | 57.5 |
| Mole Fraction Vapor % | 100 | 0 | 23.9490 | 100 | 0 | 36.8655 | 75.7586 |

| Mole Fraction/ | Stream No. | | | | | |
|---|---|---|---|---|---|---|
| Property | 78 | 80 | 84 | 86 | 90 | 98 |
| Nitrogen | 1.91624 | 59.4153 | 31.3690 | 66.3824 | 66.3824 | 63.1382 |
| CO2 | 0.00390743 | 0.000326395 | 0.00130540 | 8.31995E−05 | 8.31995E−05 | 9.63113E−05 |
| Methane | 93.0578 | 40.4845 | 68.1745 | 33.6059 | 33.6059 | 36.8483 |
| Ethane | 3.23637 | 0.0959952 | 0.435886 | 0.0115625 | 0.0115625 | 0.0134116 |
| Propane | 1.15643 | 0.00367169 | 0.0182156 | 5.88179E−05 | 5.88179E−05 | 6.84285E−05 |
| i-Butane | 0.191808 | 9.24394E−05 | 0.000463516 | 2.59683E−07 | 2.59683E−07 | 3.02223E−07 |
| n-Butane | 0.339356 | 0.000126703 | 0.000635589 | 2.90618E−07 | 2.90618E−07 | 3.38227E−07 |
| i-Pentane | 0.0488510 | 8.01840E−07 | 4.02942E−06 | 7.25372E−11 | 7.25372E−11 | 8.44290E−11 |

TABLE 2-continued

FLOW STREAM PROPERTIES

| | | | | | | |
|---|---|---|---|---|---|---|
| n-Pentane | 0.0341132 | 1.29730E−06 | 6.51838E−06 | 3.23020E−10 | 3.23020E−10 | 3.75974E−10 |
| Hexane | 0.0151182 | 8.00758E−08 | 4.02408E−07 | 4.85067E−12 | 4.85067E−12 | 5.64582E−12 |
| Temperature ° F. | 101.727* | −189.094 | −199.103 | −199.103 | −223.793 | −223.896 |
| Pressure psia | 55 | 385 | 385 | 385 | 380 | 379 |
| Mole Fraction Vapor % | 100 | 100 | 0 | 100 | 15* | 1.22020 |
| Std Vapor Volumetric Flow MMSCFD | 20.5208 | 34.9908 | 6.96253 | 28.0282 | 28.0282 | 24.0804 |

| Mole Fraction/ | Stream No. | | | | | | |
|---|---|---|---|---|---|---|---|
| Property | 102 | 106 | 110 | 114 | 116 | 118 | 120 |
| Nitrogen | 63.1382 | 98.4286 | 98.4286 | 98.4286 | 98.4286 | 98.4286 | 8.92683 |
| CO2 | 9.63113E−05 | 4.30859E−10 | 4.30859E−10 | 4.30859E−10 | 4.30859E−10 | 4.30859E−10 | 0.000178861 |
| Methane | 36.8483 | 1.57143 | 1.57143 | 1.57143 | 1.57143 | 1.57143 | 91.0478 |
| Ethane | 0.0134116 | 4.62270E−08 | 4.62270E−08 | 4.62270E−08 | 4.62270E−08 | 4.62270E−08 | 0.0250017 |
| Propane | 6.84285E−05 | 5.06148E−13 | 5.06148E−13 | 5.06148E−13 | 5.06148E−13 | 5.06148E−13 | 0.000145857 |
| i-Butane | 3.02223E−07 | 0 | 0 | 0 | 0 | 0 | 7.50616E−07 |
| n-Butane | 3.38227E−07 | 0 | 0 | 0 | 0 | 0 | 8.64757E−07 |
| i-Pentane | 8.44290E−11 | 0 | 0 | 0 | 0 | 0 | 4.25543E−10 |
| n-Pentane | 3.75974E−10 | 0 | 0 | 0 | 0 | 0 | 1.57601E−09 |
| Hexane | 5.64582E−12 | 0 | 0 | 0 | 0 | 0 | 1.78131E−11 |
| Temperature ° F. | −275.993 | −290.157 | −299.700 | −228.767 | −204.101* | 101.727* | −245.576 |
| Pressure psia | 70* | 62.5 | 20* | 19 | 18 | 17 | 65 |
| Std Vapor Volumetric Flow MMSCFD | 24.0804 | 18.7245 | 18.7245 | 18.7245 | 18.7245 | 18.7245 | 15.2885 |

| Mole Fraction/ | Stream No. | | | | |
|---|---|---|---|---|---|
| Property | 124 | 126 | 130 | 134 | 144 |
| Nitrogen | 8.92683 | 8.92683 | 7.71205 | 19.8681 | 86.1708 |
| CO2 | 0.000178861 | 0.000178861 | 0.00135433 | 6.72785E−05 | 3.22227E−06 |
| Methane | 91.0478 | 91.0478 | 90.6737 | 80.1220 | 13.8289 |
| Ethane | 0.0250017 | 0.0250017 | 1.04492 | 0.00971969 | 0.000283701 |
| Propane | 0.000145857 | 0.000145857 | 0.367883 | 9.71549E−05 | 1.96930E−07 |
| i-Butane | 7.50616E−07 | 7.50616E−07 | 0.0610024 | 7.01444E−07 | 2.08579E−10 |
| n-Butane | 8.64757E−07 | 8.64757E−07 | 0.107928 | 8.48175E−07 | 2.15697E−10 |
| i-Pentane | 4.25543E−10 | 4.25543E−10 | 0.0155364 | 7.47517E−10 | 1.60551E−15 |
| n-Pentane | 1.57601E−09 | 1.57601E−09 | 0.0108492 | 2.51368E−09 | 2.50525E−14 |
| Hexane | 1.78131E−11 | 1.78131E−11 | 0.00480815 | 2.27920E−11 | 5.04461E−16 |
| Temperature ° F. | −245.576 | −221.201 | −225.657 | −225.657 | −223.896 |
| Pressure psia | 65 | 65 | 65 | 65 | 379 |
| Std Vapor Volumetric Flow MMSCFD | 5.12485 | 5.12485 | 18.5056 | 5.98481 | 3.94784* |

| Mole Fraction/ | Stream No. | | | | | | |
|---|---|---|---|---|---|---|---|
| Property | 146 | 150 | 152 | 156 | 158 | 162 | 164 |
| Nitrogen | 86.1708 | 86.1708 | 1.93914 | 1.93914 | 1.79515 | 1.79515 | 1.79515 |
| CO2 | 3.22227E−06 | 3.22227E−06 | 0.00694044 | 0.00694044 | 0.00509588 | 0.00509588 | 0.00509588 |
| Methane | 13.8289 | 13.8289 | 88.8955 | 88.8955 | 25.8431 | 25.8431 | 25.8431 |
| Ethane | 0.000283701 | 0.000283701 | 5.89178 | 5.89178 | 10.3922 | 10.3922 | 10.3922 |
| Propane | 1.96930E−07 | 1.96930E−07 | 2.11545 | 2.11545 | 14.4181 | 14.4181 | 14.4181 |
| i-Butane | 2.08579E−10 | 2.08579E−10 | 0.350896 | 0.350896 | 6.42948 | 6.42948 | 6.42948 |
| n-Butane | 2.15697E−10 | 2.15697E−10 | 0.620824 | 0.620824 | 17.5478 | 17.5478 | 17.5478 |
| i-Pentane | 1.60551E−15 | 1.60551E−15 | 0.0893689 | 0.0893689 | 6.26342 | 6.26342 | 6.26342 |
| n-Pentane | 2.50525E−14 | 2.50525E−14 | 0.0624074 | 0.0624074 | 5.89497 | 5.89497 | 5.89497 |
| Hexane | 5.04461E−16 | 5.04461E−16 | 0.0276576 | 0.0276576 | 11.4107 | 11.4107 | 11.4107 |
| Temperature ° F. | −295.724* | −294.945 | −145.335 | −214.065 | −17.4875 | −38.8154 | 101.727* |
| Pressure psia | 374 | 70* | 388.5 | 70* | 658.5 | 165* | 160 |
| Mole Fraction Vapor % | 0 | 0 | 0 | 36.0482 | 0 | 23.0297 | 53.0054 |
| Std Vapor Volumetric Flow MMSCFD | 3.94784 | 3.94784 | 3.21712 | 3.21712 | 1.00183 | 1.00183 | 1.00183 |

TABLE 2-continued

| FLOW STREAM PROPERTIES | | | | | |
|---|---|---|---|---|---|
| Mole Fraction/ | Stream No. | | | | |
| Property | 166 | 170 | 172 | 180 | 184 |
| Nitrogen | 1.90160 | 1.90160 | 1.90160 | 8.92683 | 8.92683 |
| CO2 | 0.00196953 | 0.00196953 | 0.00196953 | 0.000178861 | 0.000178861 |
| Methane | 95.7172 | 95.7172 | 95.7172 | 91.0478 | 91.0478 |
| Ethane | 1.53973 | 1.53973 | 1.53973 | 0.0250017 | 0.0250017 |
| Propane | 0.543680 | 0.543680 | 0.543680 | 0.000145857 | 0.000145857 |
| i-Butane | 0.0901606 | 0.0901606 | 0.0901606 | 7.50616E−07 | 7.50616E−07 |
| n-Butane | 0.159516 | 0.159516 | 0.159516 | 8.64757E−07 | 8.64757E−07 |
| i-Pentane | 0.0229626 | 0.0229626 | 0.0229626 | 4.25543E−10 | 4.25543E−10 |
| n-Pentane | 0.0160351 | 0.0160351 | 0.0160351 | 1.57601E−09 | 1.57601E−09 |
| Hexane | 0.00710639 | 0.00710639 | 0.00710639 | 1.78131E−11 | 1.78131E−11 |
| Temperature ° F. | −225.657 | −227.698 | −204.007 | −245.576 | −245.576 |
| Pressure psia | 65 | 60* | 57.5 | 65 | 65 |
| Mole Fraction Vapor % | 0 | 0.990159 | 96.2238 | 0 | 0 |
| Std Vapor Volumetric Flow MMSCFD | 12.5208 | 12.5208 | 12.5208 | 10.1637 | 10.1637 |

It will be appreciated by those of ordinary skill in the art that these values are based on the particular parameters and composition of the feed stream in the above computer simulation example. The temperature, pressure, and compositional values will differ depending on the parameters and composition of the NRU Feed stream 12 and specific operating parameters for various pieces of equipment in system 10.

According to another preferred embodiment, a natural gas expander may be used in place of valve 108, which would provide a higher degree of cooling of the second column overhead stream than with the valve alone. For example, where the differential across the valve (stream 106 to stream 110) is calculated to be approximately 10° F., the differential across an expander is approximately 37° F. This higher degree of cooling results in a slightly higher purity of nitrogen to be vented in stream 118 of approximately 0.5 to 1 percent higher than when a valve 108 is used, but also significantly reduces the residue compression required. With a standard control valve in the position of valve 108 the amount of compression is calculated to be approximately 66.5 BHP/MMSCF of inlet gas. The calculated residue HP required with the expander in place instead of the valve 108 is approximately 56.4 BHP/MMSCF. This represents a near 18% reduction in compression HP along with the associated reduction in fuel or power and the associated reduction in environmental impact.

It will also be appreciated by those of ordinary skill in the art upon reading this disclosure that references to separation of nitrogen and methane used herein refer to processing an NRU feed gas to produce various multi-component product streams containing large amounts of the particular desired component, but not pure streams of any particular component. One of those product streams is a nitrogen vent stream, which is primarily comprised of nitrogen but may have small amounts of other components, such as methane and ethane. Another product stream is a processed gas stream, or sales gas stream, which is primarily comprised of methane but may have small amounts of other components, such as nitrogen, ethane, and propane. Amounts of components in the various streams described herein as a percentage are mole fraction percentage.

It will also be appreciated by those of ordinary skill in the art upon reading this disclosure that additional processing sections for removing carbon dioxide, water vapor, and possibly other components or contaminants that are present in the NRU feed stream, can also be included in the system and method of the invention, depending upon factors such as, for example, the origin and intended disposition of the product streams and the amounts of such other gases, impurities or contaminants as are present in the NRU feed stream. Other alterations and modifications of the invention will likewise become apparent to those of ordinary skill in the art upon reading this specification in view of the accompanying drawings, and it is intended that the scope of the invention disclosed herein be limited only by the broadest interpretation of the appended claims to which the inventor is legally entitled.

I claim:

1. A system for removing nitrogen and for producing a methane product stream from a feed stream comprising nitrogen, methane, and other components, the system comprising:

a first separator wherein the feed stream is separated into a first separator overhead stream and a first separator bottoms stream;

a first splitter for splitting the first separator overhead stream into a first portion and a second portion;

a first fractionating column wherein the first and second portions of the first separator overhead stream are separated into a first column overhead stream and a first column bottoms stream;

a second splitter for splitting the first column bottoms stream into four portions;

a second fractionating column wherein the first column overhead stream is separated into a second column overhead stream and a second column bottoms stream;

a second separator wherein the second column bottoms stream and a fourth portion of the first column bottoms stream are separated into a second separator overhead stream and a second separator bottoms stream;

a first mixer to mix the second separator bottoms stream and a third portion of the first column bottoms stream to form a first mixed stream;

a first heat exchanger wherein the feed stream is cooled upstream of the first separator and the first portion of the first separator overhead stream is cooled upstream of the first fractionating column through heat exchange with the first separator bottoms stream, a first portion of the first column bottoms stream, a second portion of the first column bottoms stream, the first mixed stream, and the second column overhead stream;

wherein the first portion of the first column bottoms stream is a high pressure sales gas stream having a pressure between 315 and 415 psia;

wherein the second portion of the first column bottoms stream is an intermediate pressure sales gas stream having a pressure between 115 and 215 psia; and wherein the first mixed stream is a low pressure sales gas stream having a pressure between 45 and 115 psia.

2. The system of claim 1 wherein the first fractionating column is operated at a pressure between 315 and 415 psia and the second fractionating column is operated at a pressure between 45 and 115 psia.

3. The system of claim 2 further comprising a second heat exchanger wherein the first column overhead stream is cooled upstream of the second fractionating column through heat exchange with the second column overhead stream and second separator bottoms stream.

4. The system of claim 3 further comprising a third heat exchanger wherein at least a portion of the first column overhead stream is cooled downstream of the second heat exchanger and upstream of the second fractionating column through heat exchange with the second column overhead stream.

5. The system of claim 4 further comprising a third separator for separating the first column overhead stream into a vapor portion and a liquid portion downstream of the second heat exchanger and upstream of the third heat exchanger; and wherein the vapor portion is cooled in the third heat exchanger prior to feeding into a top portion of the second fractionating column.

6. The system of claim 5 further comprising:

a third splitter for splitting the vapor portion of the first column overhead stream into a first vapor portion and a second vapor portion, wherein the first vapor portion is cooled in the third heat exchanger prior to feeding into a top portion of the second fractionating column; and a second mixer for mixing the second vapor portion with the liquid portion prior to feeding into a mid-portion of the second fractionating column.

7. The system of claim 4 further comprising a fourth heat exchanger for partially condensing a stream from a top portion of the first fractionating column through heat exchange with at least a portion of the second column bottoms stream;

wherein a liquid portion from the partially condensed stream from the top portion of the first fractionating column is returned to the first fractionating column as a reflux stream and a vapor portion of the partially condensed stream from the top portion of the first fractionating column is the first column overhead stream.

8. The system of claim 7 wherein the portion of the second column bottoms stream passes through the fourth heat exchanger by gravity feed.

9. The system of claim 7 further comprising a third splitter for splitting the second column bottoms stream into a first portion and a second portion, wherein the first portion passes through the fourth heat exchanger;

a second mixer for mixing the first portion of the second column bottoms stream downstream of the fourth heat exchanger with the second portion of the second column bottoms stream to form a second mixed stream; and wherein the second mixed stream feeds into the second separator.

10. The system of claim 9 further comprising a first valve through which the first portion of the first column bottoms stream passes to partially vaporize the first portion upstream of the first heat exchanger;

a second valve through which the second portion of the first column bottoms stream passes to partially vaporize the second portion upstream of the first heat exchanger; and a third valve through which the third portion of the first column bottoms stream passes to partially vaporize the third portion upstream of the first mixer.

11. The system of claim 10 further comprising a fourth valve, wherein the fourth portion of the first column bottoms stream passes through the fourth valve to partially vaporize the fourth portion of the first column bottoms stream prior to feeding into the second separator; and wherein the second separator overhead stream feeds into a bottom portion of the second fractionating column as an ascending vapor stream.

12. The system of claim 1 further comprising a Joule Thompson (JT) valve through which the first portion of the first separator overhead stream passes downstream of the first heat exchanger and upstream of the first fractionating column.

13. The system of 12 wherein the first portion of the first separator overhead stream feeds into the first fractionating column at a lower temperature and lower pressure than the second portion of the first separator overhead stream.

14. The system of claim 13 further comprising a reboiler for the first fractionating column, wherein the reboiler is supplied with heat from the second portion of the first separator overhead stream prior to feeding into the first fractionating column.

15. The system of claim 1 further comprising:

a third splitter for splitting the second column bottoms stream into a first portion and a second portion;

an elevated heat exchanger disposed in a position that is at least partially elevated relative to the first fractionating column, the elevated heat exchanger configured to partially condense a stream from a top portion of the first fractionating column through heat exchange with the first portion of the second column bottoms stream;

a second mixer upstream of the second separator for mixing the first portion of the second column bottoms stream downstream of the elevated heat exchanger with the second portion of the second column bottoms stream;

a first valve upstream of the second mixer to control a flow rate of the second portion of the second bottoms relative to the first portion of the second bottoms stream; and wherein a liquid portion from the partially condensed stream from the top portion of the first fractionating column is returned to the first fractionating column as a reflux stream and a vapor portion of the partially condensed stream from the top portion of the first fractionating column is the first column overhead stream.

16. The system of claim 15 further comprising:

a third separator for separating the first column overhead stream into a vapor portion and a liquid portion upstream of the second fractionating column;

a second heat exchanger wherein the first column overhead stream is cooled upstream of the third separator through heat exchange with the second column overhead stream and second separator bottoms stream;

a third heat exchanger wherein the vapor portion of the first column overhead stream is cooled downstream of the second heat exchanger and upstream of the second fractionating column through heat exchange with the second column overhead stream;

an expander or a second valve to reduce a temperature and a pressure of the second column overhead stream upstream of the fourth heat exchanger;

and wherein a temperature of the second column overhead stream exiting the third heat exchanger is 2-5° F. colder than a temperature of the vapor portion of the first column overhead stream prior to entering the third heat exchanger.

17. A method for removing nitrogen from a feed stream comprising nitrogen and methane, the method comprising the steps of:

separating the feed stream into a first separator overhead stream and a first separator bottoms stream in a first separator;

dividing the first separator overhead stream into a first portion and a second portion in a first splitter;

separating the first and second portions of the first separator overhead stream into a first column overhead stream and a first column bottoms stream in a first fractionating column operated at a pressure between 315 and 415 psia;

dividing the first column bottoms stream into a first portion, a second portion, a third portion, and a fourth portion in a second splitter;

separating the first column overhead stream into a second column overhead stream and a second column bottoms stream in a second fractionating column operated at a pressure between 45 and 115 psia;

separating the second column bottoms stream and the fourth portion of the first column bottoms stream into a second separator overhead stream and a second separator bottoms stream in a second separator;

mixing the second separator bottoms stream and the third portion of the first column bottoms stream to form a first mixed stream in a first mixer;

cooling the feed stream upstream of the first separator and cooling the first portion of the first separator overhead stream upstream of the first fractionating column through heat exchange with the first separator bottoms stream, the first portion of the first column bottoms stream, the second portion of the first column bottoms stream, the first mixed stream, and the second column overhead stream in a first heat exchanger;

wherein the first portion of the first column bottoms stream is a high pressure sales gas stream having a pressure between 315 and 415 psia;

wherein the second portion of the first column bottoms stream is an intermediate pressure sales gas stream having a pressure between 115 and 215 psia; and wherein the first mixed stream is a low pressure sales gas stream having a pressure between 45 and 115 psia.

18. The method of claim 17 further comprising:

cooling the first column overhead stream upstream of the second fractionating column through heat exchange with the second column overhead stream and second separator bottoms stream in a second heat exchanger;

separating the first column overhead stream into a third separator overhead stream and a third separator bottoms stream downstream of the second heat exchanger and upstream of a third heat exchanger in a third separator;

splitting the third separator overhead stream into a first vapor portion and a second vapor portion;

cooling the first vapor portion of the third separator overhead stream downstream of the second heat exchanger and upstream of feeding into a top portion of the second fractionating column through heat exchange with the second column overhead stream in the third heat exchanger; and mixing the second vapor portion of the third separator overhead stream with the third separator bottoms stream in a second mixer to form a second mixed stream prior to feeding the second mixed stream into a mid-portion of the second fractionating column.

19. The method of claim 18 further comprising expanding the second column overhead stream upstream of the third heat exchanger through an expander or an expansion valve.

20. The method of claim 18 further comprising splitting the second column bottoms stream into a first portion and a second portion in a third splitter;

partially condensing a stream from a top portion of the first fractionating column through heat exchange with the first portion of the second column bottoms stream in a fourth heat exchanger;

mixing the first portion of the second column bottoms stream downstream of the fourth heat exchanger with the second portion of the second column bottoms stream in a second mixer to form a third mixed stream;

wherein the third mixed stream feeds into the second separator; and wherein a liquid portion from the partially condensed stream is returned to the first fractionating column as a reflux stream and a vapor portion of the partially condensed stream is the first column overhead stream.

21. The method of claim 20 wherein the first portion of the second column bottoms stream passes through the fourth heat exchanger by gravity feed.

22. The method of claim 20 further comprising:

partially vaporizing the first, second, and third portions of the first column bottoms stream upstream of the first heat exchanger;

partially vaporizing the fourth portion of the first column bottoms stream upstream of the second separator.

23. The method of claim 22 further comprising:

expanding the first portion of the first separator overhead stream through a JT valve downstream of the first heat exchanger and prior the first portion of the first separator overhead stream feeding into the first fractionating column;

supplying reboiler heat to the first fractionating column from the second portion of the first separator overhead stream prior to the second portion of the first separator overhead stream feeding into the first fractionating column; and wherein the first portion of the first separator overhead stream feeds into the first fractionating column at a lower temperature and lower pressure than the second portion of the first separator overhead stream.

* * * * *